US006336509B1

(12) United States Patent
Polan et al.

(10) Patent No.: US 6,336,509 B1
(45) **Date of Patent: *Jan. 8, 2002**

(54) LOW PRESSURE FAST RESPONSE BULB SPRINKLERS

(75) Inventors: George S. Polan, Perkiomenville; Stephen J. Meyer, Malvern, both of PA (US); James E. Golinveaux, North Kingstown, RI (US)

(73) Assignee: Central Sprinkler Corporation, Lansdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/526,908

(22) Filed: Mar. 16, 2000

Related U.S. Application Data

(63) Continuation-in-part of application No. 09/183,990, filed on Nov. 2, 1998, which is a continuation of application No. 08/813,780, filed on Mar. 7, 1997, now Pat. No. 5,829,532

(60) Provisional application No. 60/124,607, filed on Mar. 16, 1999.

(51) Int. Cl.[7] ..... A62C 37/08

(52) U.S. Cl. ..... 169/37; 169/38; 169/40

(58) Field of Search ..... 169/37, 38, 39, 169/40, 41, 16, 28

(56) References Cited

U.S. PATENT DOCUMENTS 3,525,402 A 8/1970 Hattori
3,682,251 A 8/1972 Livingston ..... 169/37

(List continued on next page.)

OTHER PUBLICATIONS

Underwriters Laboratories, Inc., UL 1767, "Standard for Safety, Early–Suppression Fast–Response Sprinklers", First Edition, Feb., 1990.

(List continued on next page.)

*Primary Examiner*—David A. Scherbel
*Assistant Examiner*—Davis Hwu
(74) *Attorney, Agent, or Firm*—Akin, Gump, Strauss, Hauer & Feld, L.L.P.

(57) ABSTRACT

A low pressure fast response sprinkler includes a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge. A deflector is coupled with the tubular body and spaced from and generally aligned with the discharge end of the internal passageway so as to be impacted by a flow of water issuing in a column from the discharge end upon activation of the sprinkler. The deflector is configured and positioned to deflect the flow of water generally radially outwardly all around the sprinkler. A closure is releasably positioned at the discharge end of the tubular body so as to close the internal passageway by a heat responsive trigger which includes a frangible, fluid containing glass bulb trigger mounted to releasably retain the closure at the discharge end of the tubular body. The trigger has a response time indices (RTI) of less than 100 $meter^{1/2}sec^{1/2}$. A specific early suppression fast response pendent sprinkler with a nominal K factor of 25, an RTI of less than 40 $m^{1/2}sec^{1/2}$ and delivering at least 100 gallons per minute at an operating pressure at or below 20 psig is described.

50 Claims, 9 Drawing Sheets

U.S. PATENT DOCUMENTS

| | | | | | |
|---|---|---|---|---|---|
| 3,722,596 | A | | 3/1973 | Livingston | |
| 3,768,736 | A | | 10/1973 | Cox | |
| 3,811,511 | A | * | 5/1974 | McCulloch | 169/28 |
| 3,888,313 | A | | 6/1975 | Freeman | |
| 3,904,126 | A | | 9/1975 | Allard | |
| 4,091,873 | A | | 5/1978 | Werner | |
| 4,099,675 | A | | 7/1978 | Wohler et al. | |
| 4,136,740 | A | | 1/1979 | Groos et al. | |
| 4,279,309 | A | | 7/1981 | Fischer et al. | |
| 4,359,097 | A | * | 11/1982 | Claussen | 169/16 |
| 4,405,018 | A | | 9/1983 | Fischer | |
| 4,580,729 | A | | 4/1986 | Pounder | |
| 4,657,085 | A | | 4/1987 | Jacobsen | 169/38 |
| 4,800,961 | A | | 1/1989 | Klein | |
| 4,893,679 | A | | 1/1990 | Martin et al. | 169/39 |
| 4,901,799 | A | | 2/1990 | Pepi et al. | |
| 4,930,578 | A | | 6/1990 | Barnett et al. | |
| 5,036,923 | A | | 8/1991 | Shea | 169/37 |
| 5,094,298 | A | | 3/1992 | Polan | 169/37 |
| 5,366,022 | A | | 11/1994 | Meyer et al. | |
| 5,579,846 | A | | 12/1996 | Meyer et al. | |
| 5,584,344 | A | | 12/1996 | Meyer et al. | |
| 5,609,211 | A | | 3/1997 | Meyer et al. | |
| 5,622,225 | A | | 4/1997 | Sundholm | 169/38 |
| 5,664,630 | A | * | 9/1997 | Meyer et al. | 169/37 |
| 5,829,532 | A | * | 11/1998 | Meyer et al. | 169/37 |
| 5,853,215 | A | * | 12/1998 | Lowery | 296/24.1 |

OTHER PUBLICATIONS

Factory Mutual Engineering Corp., "Loss Prevention Data, 2–2", "Early Suppression Fast Response Sprinklers", Apr., 1987.

Factory Mutual Research, "Approval Standard, Early Suppression Fast Response Automatic Sprinklers", Jun., 1986.

"Automatic" Sprinkler Corporation of America product sheets entitled "Automatic ESFR Glass Bulb Sprinkler", Feb., 1988, (pp. J 5.3, J 5.4).

ASCOA Fire Systems data sheets entitled, "Automatic ESFR Glass Bulb Sprinkler", Mar., 1992, (pp. 1.1, 1.2).

Grinnell Corporation data sheets entitled "Early Suppression Fast Response Sprinklers/Model ESFR–1 Pendent, 14.3 K–Factor", Apr., 1988.

Reliable Automatic Sprinkler product announcement, "ESFR, Model H Early Suppression Fast Response Sprinkler", Oct., 1992, (3 pp. total).

Central Sprinkler Company catalog sheets entitled, "Central ESFR–1 3–93/ESFR Early Suppression Fast Response", 4 pp. Mar., 1993.

Drawing entitled "International Jumbo Sprinkler Head—Deflector", Dwg. No. 1–117, Automatic Sprinkler Co. of America, Mar., 1926 (1 pg.).

Sheet entitled "Grinnell Jumbo Sprinkler Issue A", Grinnell Corp., Feb., 1969, (1 pg.).

Drawing entitled "Solder Type—Issue "A" 1¼" Grinnell Jumbo Sprinkler Yoke, Body, Strut, Diaphragm and Disc", General Fire Extinguisher Company, Apr., 1917 (1 pg.).

Drawing entitled "1" Grinnell Jumbo Sprinkler Detail Solder Type Isse 'A'", General Fire Extinguisher Co., Apr., 1917, (1 pg.).

N.J. Thompson, *Fire Behavior and Sprinklers*, Chapter 6 "Automatic Sprinkler Protection", National Fire Protection Association, 1964, Cover, Foreward, Table of Contents and pp. 72–91.

Newsletter for Fire Protection Engineers and Industry, No. 11, Jul., 1965, Orinda, California, (8 pp.).

D.G. Goodfellow, et al., Technical Report entitled "Optimization of Sprinkler Protection for United States Postal Service III. Protection of Plastic Letter Trays", Factory Mutual Research Corporation, Oct., 1971 (39 pp.).

D.G. Goodfellow, Technical Report entitled "Optimization of Sprinkler Protection for United States Postal Facilities/IV Protection of Plastic Letter Trays with 0.64–in. Retrofit Sprinklers", Factory Mutual Research Corporation, Jul., 1974 (30 pp. with cover and introductory pages).

E.W.J. Troup, Technical Report entitled "New Developments in Ceiling–Level Protection for the High–Challenge Fire", Factory Mutual Research Corporation, January, 1974.

P.J. Chicarello et al., Technical Report entitled Large–Scale Fire Test Evaluation of Early Suppression Fast Response (ESFR) Automatic Sprinklers, Factory Mutual Research Corporation, (cover—p. 18 and pp. 122–128), May, 1986.

C. Yao, "The Development of the ESFR Sprinkler System", *Fire Safety Journal*, Elsevier Scientific Ltd. Kidlington, Oxford, U.K., vol. 14, No. 1, pp. 65–73, 1988.

C. Yao, "Overview of FMRC's Sprinkler Technology Research", Factory Mutual Research Corp., May, 1992.

*Approved Product News*, Factory Mutual Engineering Corp., vol. 4, No. 2, Dec., 1988, pp. 1–5, 8–12 and 16.

*Fire Protection Handbook*, Seventeenth Edition, National Fire Protection Association, 1991, Title page, inner page, Table of Contents p. IX and pp. 5–127 through 5–163 and 5–174 through 5–197.

K. Bell, "Presentation to American Fire Sprinkler Association—Large K–Factor Sprinklers", Nov., 1992, (59 pp. total: 19 pp. text and 40 pp. slide photocopies).

Color photocopies of six color photographs of sprinkler cast with "I.S. Co." on deflector and "PAT.03" on the body and "1903" stamped on the release link (labeled Jun., 1995) (2pp.).

Color photocopies of six color photographs of sprinkler cast with "Globe" and "280" on body, "G A S Co." on deflector and stamped "1926" on release link (labeled Jun., 1995) (2 pp.).

Color photocopies of five color photographs of Grinnell Corporation "Jumbo A" automatic sprinkler—1¼" orifice, (labeled Jun., 1995) (2 pp.).

Color photocopies of five color photographs of Grinnell Corporation "Jumbo A" automatic sprinkler—1" orifice, (labeled Jun., 1995) (2 pp.) (body painted red).

*Standard for Installation of Sprinkler Systems* NFPA 13 National Fire Protection Association, Quincy, MA, 1994 Edition, pp. 13–1 through 13–124.

Meeting Minutes, New Technology Task Group and Working Group Meetings at Underwriters Laboratories, Inc., Northbrook, IL, Jun. 23–24, 1994, 8 pp..

Meeting Minutes, NFPA 13 New Technology Task Group Special Task Force, Jun. 24, 1994 Meeting, Underwriters Laboratories, Inc., 4 pp..

Meeting Minutes, NFPA 13 New Technology Task Group Special Task Force, Aug. 2 and 3, 1994 at National Fire Protection Association, 6 pp..

Meeting Minutes (draft), NFPA 13 New Technology Task Group Special Task Force, Sep. 13 and 14, 1994 at NFPA, 2 pp..

Meeting Minutes, National Fire Sprinkler Association, Inc. Engineering and Standards Committee, Sep. 22–23, 1994 at Burlington, VT. 15 pp..

Meeting Minutes, NFPA 13 New Technology Task Group, Feb. 23, 1995 at Chantilly, VA 3 pp..

*Sprinkler Tech Notes*, National Fire Sprinkler Association, Inc., Patterson, NY, vol. XVIII No. 4, Jul./Aug., 1995, 4 pp..
1996 Annual Meeting Report on Proposals, National Fire Protection Association, Quincy, MA, Aug., 1995, pp. 693–804.
Meeting Minutes, National Fire Sprinkler Association, Engineering and Standards Committees, Sep. 28–29, 1995 at , Reno, NV, 14 pp..
1996 Annual Meeting Report on Comments, National Fire Protection Association, Quincy, MA, 1996, pp. 172–204.
NFPA 13 Installation of Sprinkler Systems, National Fire Protection Association, Quincy, MA, Jul., 1996, pp. 13–1 through 13–148 plus r unnumbered sheets.

M. Puchovsky, Entering the Next 100 Years of Standardized Sprinkler System Technology, *Sprinkler Age*, American Fire Sprinkler Association, Inc., Dallas, TX, vol. 15, No. 3, Mar., 1998, pp. 5, 10, 12, 14, 15, 18 and 19.

* cited by examiner

LOW PRESSURE FAST RESPONSE BULB SPRINKLERS

CROSS REFERENCE TO RELATED APPPLICATIONS

This application is a continuation-in-part of U.S. Non-provisional application Ser. No. 09/183,990 filed Nov. 2, 1998, which is a continuation of U.S. Ser. No. 08/813,780, now U.S. Pat. No. 5,829,532, and a continuation-in-part of U.S. Provisional Application No. 60/124,607 filed Mar. 16, 1999.

BACKGROUND OF THE INVENTION

Early suppression fast response ("ESFR") sprinklers are a well known and well defined class of ceiling fire sprinklers. ESFR sprinklers were developed in the 1980's by Factory Mutual Research Corporation ("FM") with the assistance of certain sprinkler manufacturers in an effort to provide improved fire protection against certain high-challenge fire hazards. According to FM, ESFR sprinklers combine fast response with greater supplied and actually delivered water densities for greater fire suppression capability. Previous sprinklers (standard sprinklers) provided protection by merely keeping such fires under control. Ultimately the initial fuel source would deplete itself or other fire fighting equipment would have to be brought to the scene to extinguish the fire.

The performance requirements of ESFR sprinklers are set forth in Underwriters Laboratories, Inc. ("UL") STANDARD FOR EARLY-SUPPRESSION FAST-RESPONSE SPRINKLERS UL 1767. This standard was first published in 1990. Factory Mutual Research Corporation ("Factory Mutual" or "FM") also has an Approval Standard For Early Suppression—Fast Response (ESFR) Automatic Sprinklers, Class Number 2008. The current ESFR standards and all earlier ESFR standards of either organization are incorporated by reference herein in their entirety.

Requirements for the installation and use of ESFR sprinklers are included in various standards of the National Fire Protection Association including the Standard for the Installation of Sprinkler Systems, NFPA 13; the Standard for General Storage, NFPA 231; and the Standard for Rack Storage of Materials, NFPA 231c. The current and earlier editions of these standards to the extent that they pertain to ESFR sprinklers are incorporated by reference herein. Installation and use requirements for ESFR sprinklers are also given Loss Prevention Data sheets 2-2, "EARLY SUPPRESSION FAST RESPONSE SPRINKLERS", *Factory Mutual System,* Factory Mutual Engineering Corp., 1987, which is also incorporated by reference herein. Loss Prevention Data sheets 2-8 N, "Installation of Sprinkler Systems", *Factory Mutual System,* Factory Mutual Engineering Corp., 1989, presents other installation and use requirements for ESFR and other sprinklers generally which are not presented in Loss Prevention Data sheets 2-2 and is also incorporated herein.

The standards specify the construction, performance, installation and operation of ESFR sprinklers with significant particularity. For example, the discharge coefficient (or "K" factor) of an ESFR sprinkler is nominally 14 and must be within the range of 13.5–14.5, where the discharge coefficient is calculated by dividing the flow of water in gallons per minute through the sprinkler by the square root of the pressure of water supplied to the sprinkler in pounds per square inch gauge. Ordinary or standard sprinklers are considered to have response time indices ("RTI") of 100 meter$^{1/2}$second$^{1/2}$ ("m$^{1/2}$sec$^{1/2}$") or more although the response time indices actually reported for these sprinklers have all exceeded 100 m$^{1/2}$sec$^{1/2}$. One special class of faster operating sprinklers exists with response time indices between 50 and 80 m$^{1/2}$sec$^{1/2}$. Existing ESFR sprinklers must exhibit response time indices of less than 40 m$^{1/2}$sec$^{1/2}$. The installation and use standards further require, among other things, that a minimum operating pressure of 50 psi be provided to ESFR sprinklers.

ESFR sprinklers were originally designed to suppress fires in warehouses with thirty-foot ceilings where flammable stock such as certain plastics is piled up to twenty-five feet high in racks. In many instances, available water supplies are not capable of providing a minimum operating pressure of 50 psi to thirty-foot high sprinklers. In such cases, a supplemental pump is needed to boost water pressure before ESFR sprinklers can be used. The cost of providing an auxiliary pump can be significant. For example, in protecting a 40,000 square foot building with ESFR sprinklers, it is estimated that the cost of providing an auxiliary pump can represent about twenty-five (25) percent of the entire cost of the installed sprinkler system. In certain installations, a second, back-up pump may be needed. If comparable protection might be provided at pressures below the current 50 psig minimum required pressured for ESFR sprinklers, the need for a pump might be avoided. In instances where a pump would be required in any event, lower pressure requirements may permit the use of a lower capacity, less expensive pump or the use of the same pump with smaller diameter, higher friction but less expensive supply lines. Each of these three possible options could provide significant savings in installation costs of ESFR sprinklers.

BRIEF SUMMARY OF THE INVENTION

In one aspect the invention is a low pressure fast response bulb sprinkler comprising a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the internal passageway in pounds per square inch gauge; a deflector coupled with the tubular body and spaced from and generally aligned with the discharge end of the internal passageway so as to be impacted by a flow of water issuing from the discharge end of the passageway upon activation of the sprinkler, the deflector being configured and positioned to deflect the flow of water generally radially outwardly all around the sprinkler; a closure releasably positioned at the discharge end of the tubular body so as to close the internal passageway; and a heat responsive trigger at least including a frangible liquid containing glass bulb mounted to releasably retain the closure at the discharge end of the tubular body, the glass bulb having a response time index of less than 100 meter$^{1/2}$sec$^{1/2}$ (m$^{1/2}$sec$^{1/2}$).

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings which are diagrammatic.

DETAILED DESCRIPTION OF THE INVENTION

Figure 1:
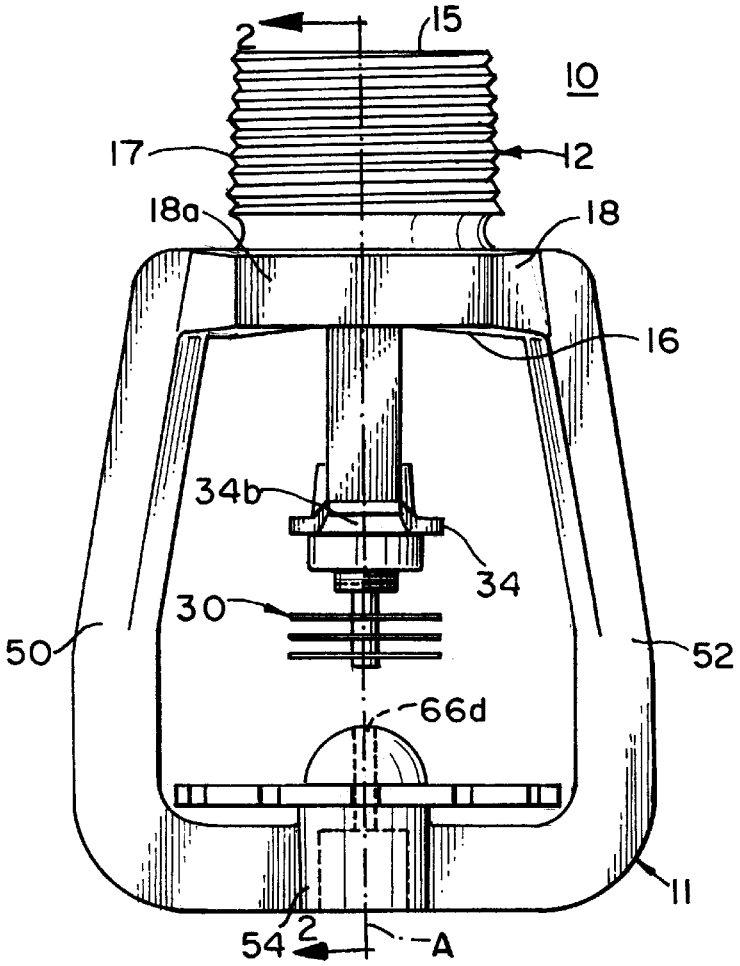
FIG. 1 is an elevation view of an low pressure, early suppression fast response ceiling sprinkler of the present invention.

In the drawings, like numerals are used to indicate like elements throughout. There is shown in various views in FIGS. 1, 2 and 5, a low pressure, early suppression fast response fire sprinkler of the present invention indicated generally at 10. Sprinkler 10 includes a preferably one-piece frame 11 having an at least generally tubular body indicated generally at 12 with a preferably tapered, central, internal passageway 14. The passageway 14 preferably extends straight between an inlet end 15 and a discharge end 16 of the tubular body 12. Threads 17 are provided on the outside of the inlet end 15 to permit the sprinkler 10 to be coupled to a drop or supply pipe (neither depicted) for delivery of water or another fire fighting fluid. The internal passageway 14 of body 12 has a preferably straight central axis A indicated in FIGS. 1 and 2.

Sprinkler 10 further includes a closure 20 releasably positioned at the discharge end 16 of the tubular body 12 so as to close the internal passageway 14, a heat responsive trigger indicated generally at 30 mounted to releasably retain the closure 20 at the discharge end 16 of the tubular body 12 closing the passageway 14 until the trigger 30 is activated, and a deflector indicated generally at 60.

Referring to FIG. 1, the frame 11 further includes a pair of support arms 50, 52 which extend generally away from opposite sides of the discharge end 16 of the tubular body 12 and meet to form a tubular knuckle 54 located along central axis A. The arms 50, 52 and knuckle 54 support the deflector 60 positioned juxtaposed to, facing and spaced away from the discharge end 16 of the tubular body 12. While at least two symmetrically positioned support arms 50, 52 are preferred, three or four support arms might be provided, preferably all symmetrically positioned around and spaced away from the central axis A. Where more than two support arms are provided, they may be separately attached to a tubular body, for example, by being threaded into a flange portion of such separate tubular body.

The frame 11 is preferably enlarged at the discharge end 16 of the tubular body 12 into a circumferential flange 18. The flange 18 is preferably hexagonally shaped with a pair of major opposing parallel flat surfaces or "flats" 18*a* positioned to receive an open ended wrench or a specially designed hexagonal sprinkler wrench for threading the sprinkler 10 into a drop or other fluid supply line (neither depicted).

Figures 2, 3:
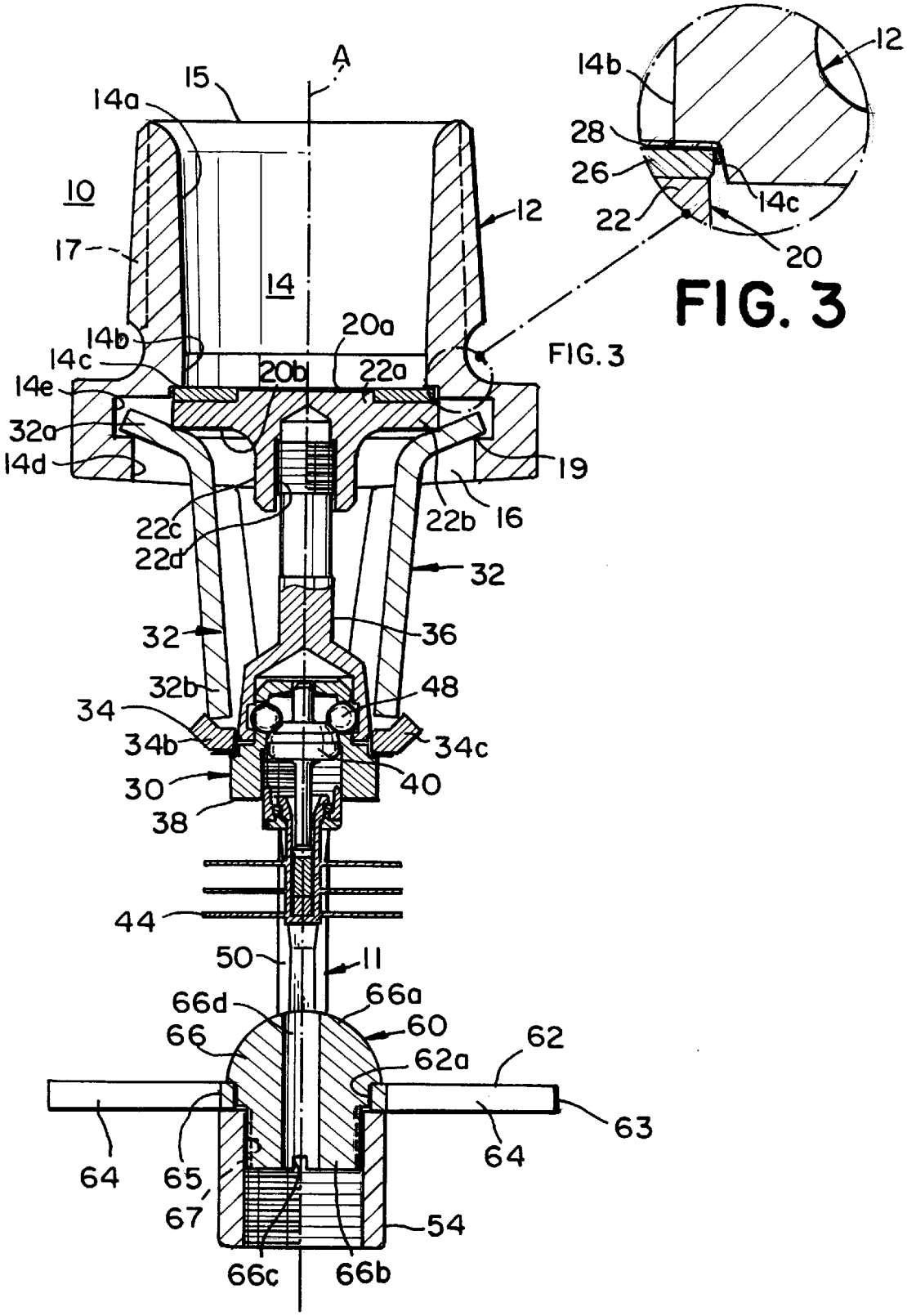
FIG. 2 is a partial cross-sectional view of the sprinkler taken generally along the lines of 2—2 in FIG. 1.
FIG. 3 is a greatly enlarged view of the encircled area 3 of FIG. 2.

Referring to FIG. 2, the internal passageway 14 includes an inwardly tapering portion 14*a* extending from the inlet end 16 to a cylindrical portion 14*b* of uniform, reduced diameter. A portion 14*c* of the passageway immediately downstream from the reduced diameter portion 14*b* is provided with a greater diameter to receive the closure 20 over the reduced diameter portion 14*b*. Portion 14*c* may be outwardly beveled at approximately a 10°–15° angle for its length to foster release of the closure 20 (see FIG. 3). The passageway 14 then abruptly and significantly enlarges in diameter into a cylindrical outlet opening 14*d* at the discharge end 16 of the frame body 12. A lip 19 is formed around the outlet opening 14*d* by the provision of a circular groove 14*e* between the lip 19 and the beveled end of portion 14*c* of the passageway.

The tubular body 12 may have an axial length of about one and one-third inches with the flange 18 having a length of about one-third inch. The inwardly tapering portion 14*a* may have a length of about seven-eighths of an inch and taper down at about a one and one-half degree angle to central axis A from a width of 0.98 to a width of 0.93 inches, which is continued for about one-eighth of an inch in reduced diameter portion 14*b*. Portion 14*c* may have a minimum diameter of about one inch and a length of about one-sixteenth inch. In the preferred embodiment, the outlet opening 14*d* may have a diameter of about one and one-third inches and an axial length of about one-third inch while the groove 14*e* has a diameter of about one and one-half inches and an axial length of only about one-eighth inch.

The preferred sprinkler 10 has a nominal discharge coefficient or K factor of 25. The discharge coefficient or K factor equals the flow of water through the internal passageway 14 in gallons per minute divided by the square root of the pressure of water fed into the tubular body in pounds per square inch gauge. The discharge coefficient is governed in a large degree by the smallest cross sectional area of the passageway 14, in other words, the diameter of the cylindrical portion 14*b* of passageway 14.

The discharge coefficient or "K" factor of a sprinkler is determined by standard flow testing. For ESFR sprinklers, passageway 14 is measured first at a pressure of 15 psig, and then in 5 psig increments up to 50 psig and then in 10 psig increments up to 100 psig, and then in 25 psig increments at 125, 150 and 175 psig. The flow is decreased in the same increments back to the original 15 psig value. The flow is measured at each increment of pressure by a flow-measuring device having an accuracy within about 2 percent of the actual flow. The actual flow in gallons per minute is divided by the square root of the pressure of the supplied water in psig at each increment. An average value is then calculated from all of the incremental values and becomes the flow coefficient or "K" factor of the sprinkler.

Discharge coefficients of K factors can be "nominal" values. Typically "nominal" K factors are expressed in standard sizes, which are integer or half integer values.

These standard or "nominal" values encompass the stated integer or half integer value plus or minus one-half integer. Thus, a nominal K factor of 25 encompasses all measured K factors between 24.5 and 25.5.

Referring to FIG. 2, the closure 20 preferably is also a subassembly and has an upstream end 20*a*, which is received over the reduced diameter portion 14*b* of the passageway 14 in the beveled portion 14*c* of the passageway. A downstream end 20*b* of the closure 20 engages a proximal end of the trigger 30. Referring to FIG. 3, the closure 20 is formed by a saddle 22 and a washer subassembly that includes a Belleville washer 26 bearing a sheet of plastic film tape 28, preferably a tetrafluoroethylene tape on one side, which is the side of the closure 20 facing the uniform reduced diameter portion 14*b* of the passageway 14. Saddle 22 is a generally rotationally symmetric body including a cylindrical plug portion 22*a*, which is received within a center opening of the Belleville washer 26 to stabilize the washer with respect to the saddle 22. The saddle has a circular flange portion 22*b* with an outer diameter approximately equal to the outer diameter of the Belleville washer 26 and slightly greater than the diameter of reduced diameter portion 14*b*. Saddle 22 further includes a central circular boss 22*c* projecting away from the plug portion 22*a* with a threaded central bore 22*d*.

The preferred trigger 30 is an assembly which preferably includes a pair of identical, generally L-shaped levers 32. Each lever 32 includes a short arm portion 32*a*, which is positioned between lip 19 and the downstream end 20*b* of the closure 20, releasably retaining the closure 20 in the internal passageway 14 closing the passageway. Long arm portions 32*b* of the levers 32 extend away from discharge end 16 of the tubular body 12 and passageway 14 and are held together by a lever yoke 34. Yoke 34 preferably is a one-piece, generally octagonally-shaped body with a central circular opening. Diametrically opposed portions 34*b* and 34*c* of the body are bent around the proximal long ends 32*b* of the levers 32, thereby holding those ends together and releasably retaining the closure 20 in the passageway 14 so as to close the passageway 14. Cutouts can be provided on the outer edges of the flange portion 22*b* of the saddle to receive and stabilize the position of the short arm portions 32*a* of the levers 32.

Figure 4:
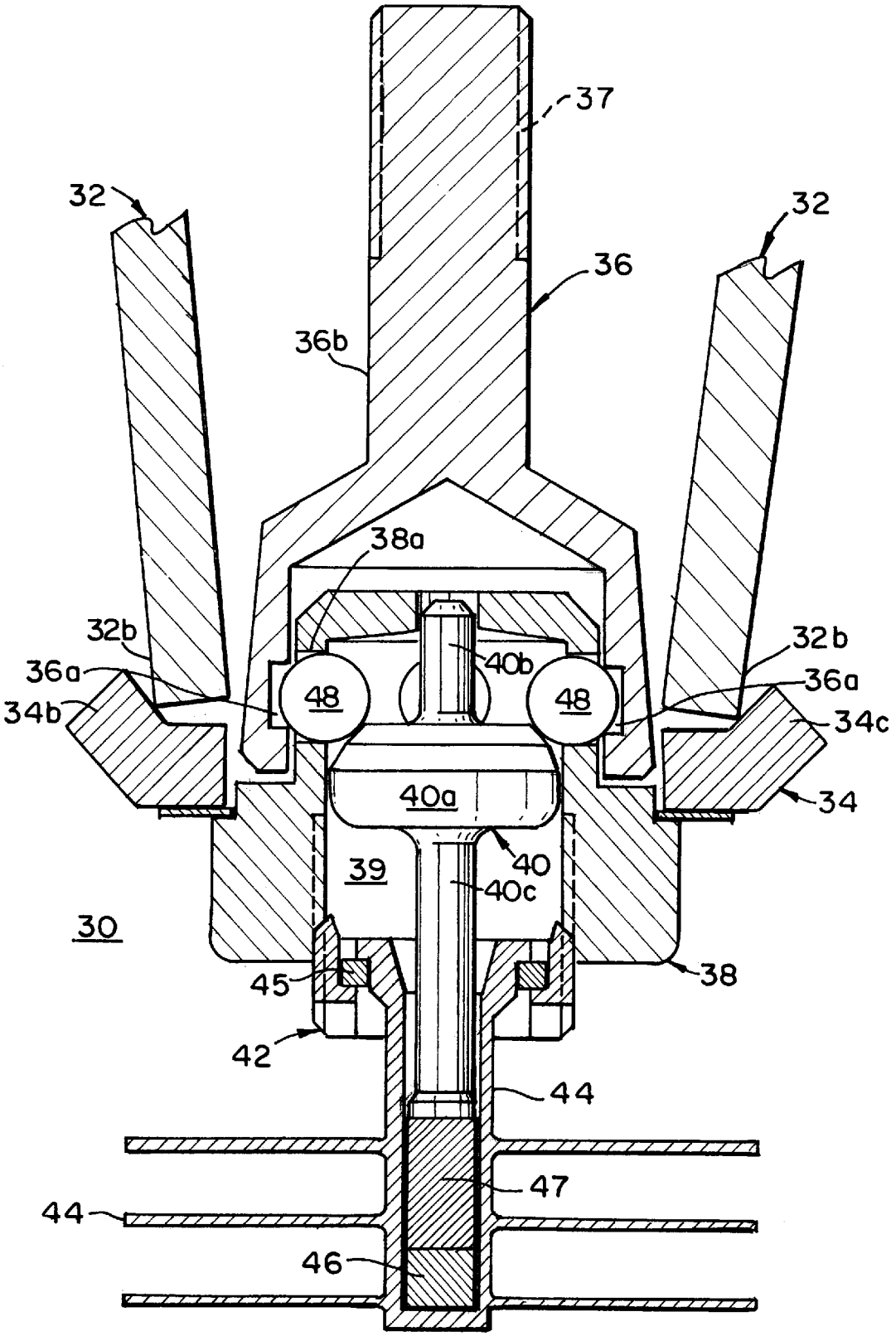
FIG. 4 is a sectional elevation of the trigger.
Figure 6:
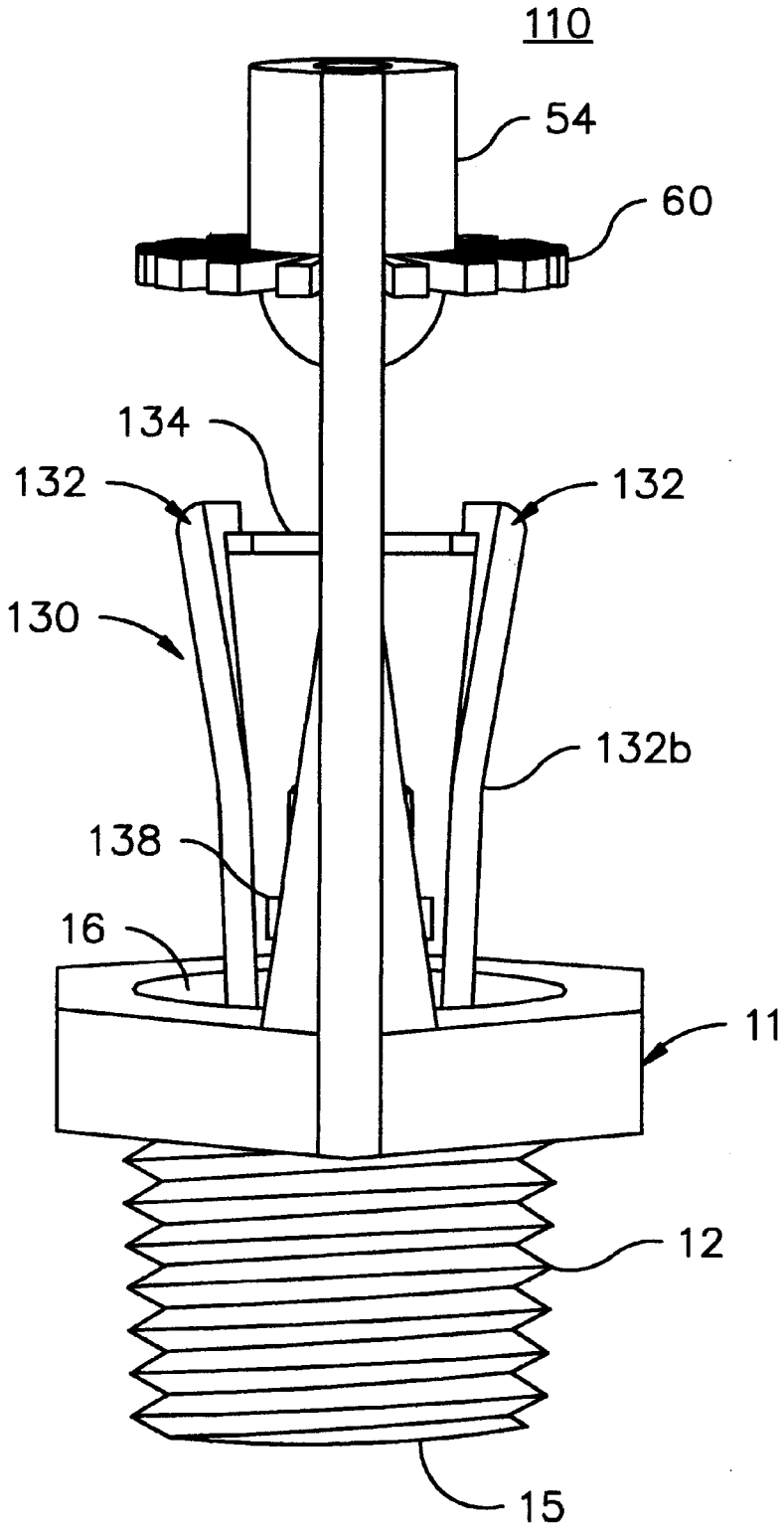
FIGS. 6 and 7 are orthogonal elevation views of a first low pressure, early suppression fast response glass bulb ceiling sprinkler of the present invention.
Figure 7:
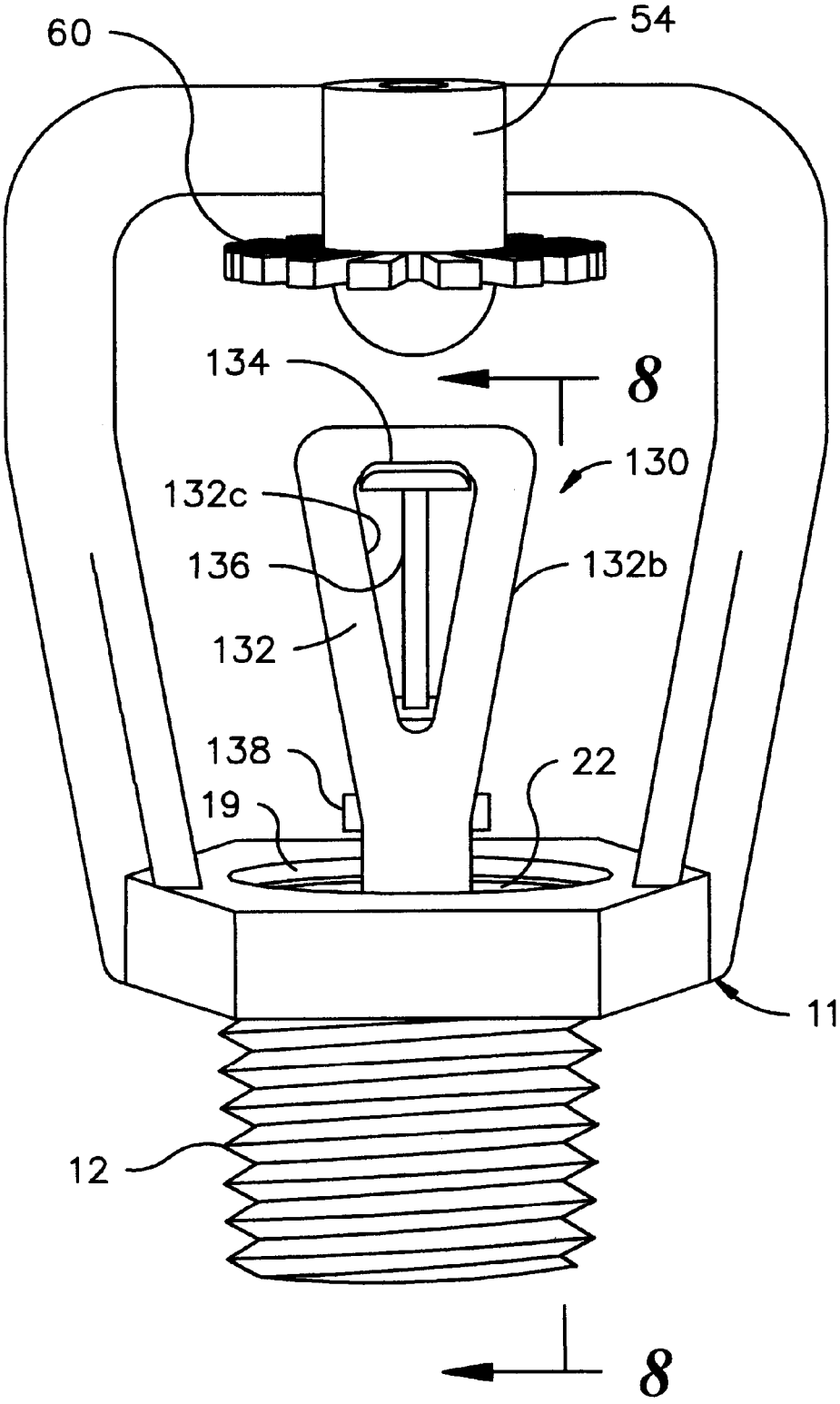
Figure 9:
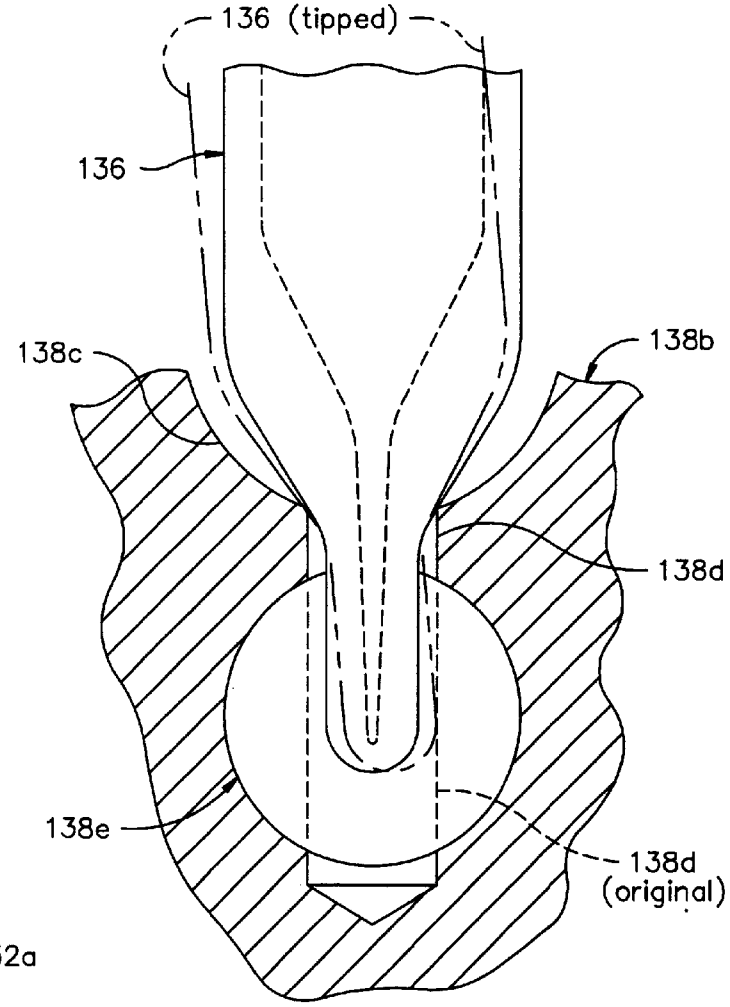
FIG. 9 is a detailed section of the pedestal in FIG. 8.
Figure 8:
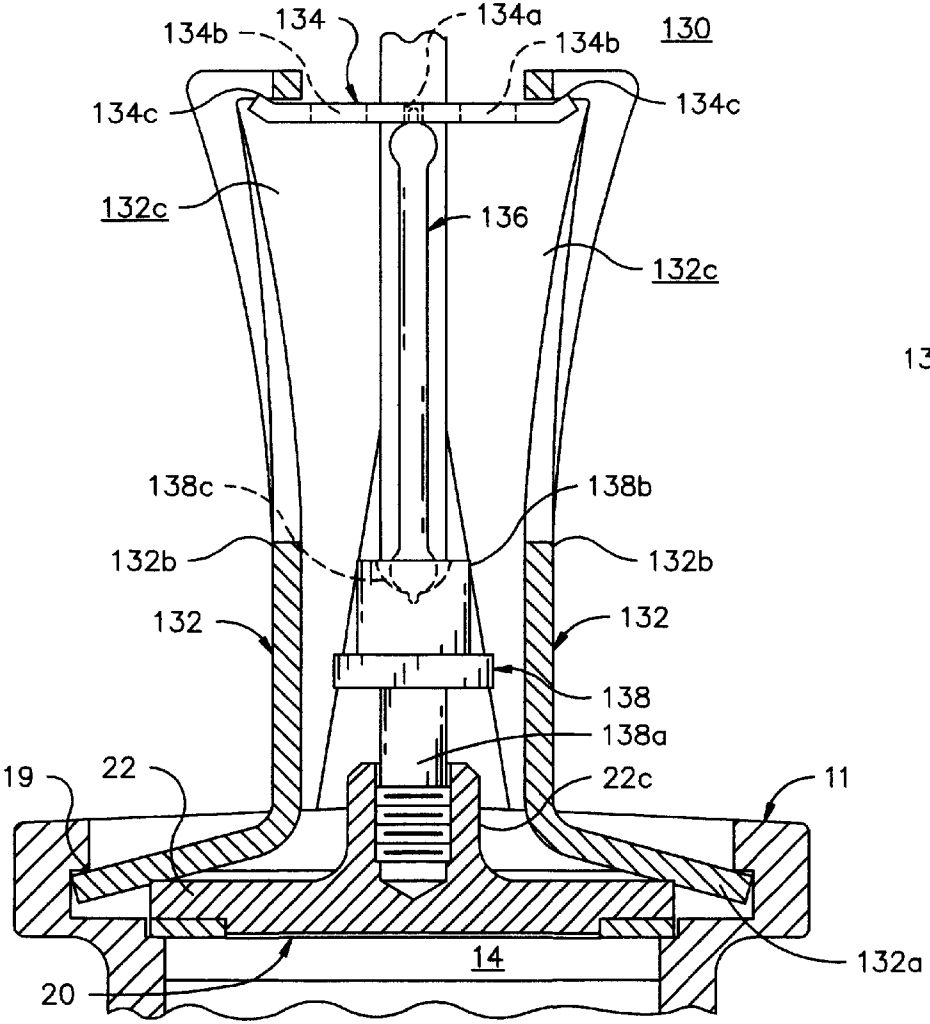
FIG. 8 is a partially sectioned view of the sprinkler of FIGS. 6 and 7 taken along the lines 8—8 in FIG. 7 showing details of the mounting supporting the glass bulb and retaining the closure.

Referring to FIGS. 2 and 4, trigger 30 further includes a retainer body 36, a plunger housing 38 having one end received in the retainer body 36 and a retaining nut received in a remaining end of the plunger housing 38 and forming a plunger chamber 39 receiving a plunger 40. Those and other elements of trigger 30 are best seen in FIG. 4. A retaining nut 43 supports a finned heat collector 44 from a side of the plunger housing 38 opposite the retainer body 36. The finned heat collector 44 is preferably coupled with and thermally insulated from the retaining nut 43 by a thermally insulative support washer 45 of a suitable material such as glass reinforced nylon. The finned heat collector 44 is hollow and contains a pellet 46 of a metal alloy having a melting temperature at the desired operating or response temperature of the sprinkler 10. Plunger 40 is formed by a pin and a generally bulbous main body 40*a* along the pin, which divides the pin into upper and lower ends 40*b* and 40*c*. The lower pin end 40*c* of plunger 40 is supported on the metal alloy pellet 46 by a cylindrical bearing disk 47 made of a material such as alumina having significant compressive strength and thermal insulative properties. The upper pin end 40*b* guides and centers the plunger 40 in the chamber 39. The purpose of the pellet 46, bearing disk 47 and plunger 40 is to support a plurality of balls 48 which extend through bores 38*a* in the side walls of the plunger housing 38 and into aligned recesses 36*a* in the retainer body 36 thereby releasably locking the retainer body 36 and plunger housing 38 together. The "free" or "upper end" 36*b* of the retainer body 36 ears external threads 37 (diagrammatically by phantom), which are received in the threaded central bore 22*d* of the saddle 22 of the closure 20. Levers 32, which are held together by lever yoke 34, releasably retain closure 20 in the tubular body 12. The retainer body 36 is held through saddle 22 and the remainder of the trigger 30 is coupled with the saddle through the retainer body 36 by means of the balls 48. The balls 48, in turn, are held by the bulbous main body 40*a* of the plunger 40, which is forced against the balls 48 by tightening of the retaining nut 43 into the plunger housing 38. The alloy pellet 46 will lose its load bearing strength when heated sufficiently allowing the balls to move and permitting the plunger housing 38 and lever yoke 34 to separate from the retainer body 36 and levers 32, respectively, releasing closure 20 with trigger 30 permitting water (or other fire fighting fluid) to pass through the internal passageway 14 and from the discharge end 16 of the passageway 14 and body 12.

Figure 5:
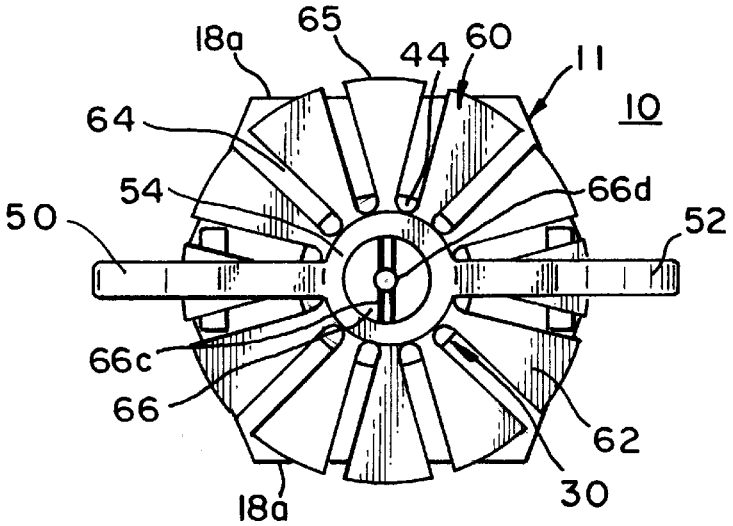
FIG. 5 is a bottom view of the sprinkler of FIG. 1.

The structure and mounting of the deflector 60 are best seen in FIGS. 1, 2 and 5. Deflector 60 includes a plate 62, and a nose piece positioned in an opening in the center of the plate 42.

The plate 62 of the deflector is planar and circular with a circular outer perimeter 63 and a plurality of slots 64 extending radially inwardly from the circular perimeter 63 and axially entirely through the plate 62. The plurality of slots 64 surround and define a "slotless" central area 65 as best seen in FIG. 2. As used herein "slotless central area" refers to a circular central area at the center of the deflector, which has a radius equal to the radius of the plate member less the radial length of the longest slot extending radially from the outer perimeter of the plate member in a planar projection of the deflector perpendicular to central axis A. Thus, if the nose piece of the deflector overlaps the innermost ends of some or all of the slots, the slotless central area is the planar area of the nose piece which covers the ends of such slots. In the preferred embodiment, the outer diameter of the central area 65 is substantially equivalent to the outer diameter of the frame knuckle 54.

The nose piece 66 has a head portion 66*a* facing the tubular body 14 which is suggestedly rounded in shape and preferably hemispheric. The head portion 66*a* supports a shaft portion 66*b* bearing external threads 67 (indicated diagrammatically by phantom lines) which permit the nose piece 66 to be screwed into the internally threaded knuckle 54. A slot 66*c* may be provided at the base of the shaft portion 66*b* to receive a screw driver. The nose piece passes through a circular opening 62*a* provided in the center of the deflector plate 62 (within the central area 65) and holds the plate 62 firmly to the knuckle 54. The deflector 60 is coupled with the tubular body 14 through knuckle 54 and is positioned juxtaposed to and spaced from the discharge end 16 of the tubular body 12 aligned with the discharge end 16 of the internal passageway central axis A of the tubular body. Nose piece 66 is further preferably provided with a central bore 66*d* also aligned with the central axis A of the internal passageway 14 and discharge end 16 of the tubular body 12. The deflector 60 is configured by being generally rotationally symmetric and positioned by being centered on central axis A to deflect the flow of water issuing from the discharge end of internal passageway 14 generally symmetrically radially outwardly all around the sprinkler 10. Bore 66*d* permits water to pass axially entirely through the center of the deflector 60 and down directly under the sprinkler 10. This bore 66*d* combined with the much larger orifice size of internal passageway 14 in comparison to the diameter of the slotless central area of the deflector has proven sufficient to deliver adequate water densities directly beneath the sprinkler 10 to suppress high challenge fires originating directly under sprinkler 10 as well as to such fires originating between such sprinklers 10.

Sprinklers 10 of the present invention are installed in accordance with standard ESFR limitations including spacing and height limitations.

For the preferred 25 K factor tubular body having a minimum diameter of 0.930 inches in the reduced diameter cylindrical portion 14*b* of the internal passageway 14, the head portion 66*a* of the nose piece 66 is provided with a radius of about one-quarter inch and with a bore 66*d* having a diameter of about one-eighth inch. The deflector plate 62 is preferably 1.9 inches in outer diameter and about one-tenth of an inch thick. Plate 62 is provided with twelve slots 64 uniformly angularly arrayed in 30° increments around central axis A. Each slot 64 is about one-tenth inch in width and terminates in a radius (semicircle). The diameter of the central area surrounded by and located within the slots 64 is suggestedly about five-eighths inch.

The surface of the knuckle 54 closest to the tubular body 14 is spaced about two and one-half inches from the proximal end of the reduced diameter cylindrical portion 14*b* of the internal passageway 14. The ratio of the outer diameter of the deflector 60, more particularly the deflector plate 62, to the radial length of the slots 64 is about 3 (1.9/0.635). The plurality of slots 64 provide a total open area of less than one-third but more than one-quarter the total planar area within the circular perimeter 63 of the deflector. All of these values are within the ranges exhibited by existing ESFR sprinklers. However, the ratio of the minimum passageway diameter of the tubular body to the diameter of the central area of the deflector is about 1.5 (0.93 in/0.624 in). The highest ratio previously exhibited in an ESFR sprinkler was less than 1.3.

One of the requirements for an ESFR sprinkler is fast response. Response can be measured in various ways. Factory Mutual and Underwriters Laboratories, use a combination of temperature ratings and response time indices to insure adequately fast response is being provided.

The response time indices or "RTI" is a measure of thermal sensitivity and is related to the thermal inertia of a heat responsive element of a sprinkler. RTI is insensitive to temperature. For fast-growing industrial fires of the type to be protected by ESFR sprinklers, it is believed that the RTI and temperature rating of the trigger are sufficient to insure adequately fast sprinkler response. The temperature rating is the range of operating temperatures at which the heat responsive element of a sprinkler will activate.

RTI is equal to $\tau u^{1/2}$ where $\tau$ is the thermal time constant of the trigger in units of seconds and u is the velocity of the gas across the trigger. RTI is determined experimentally in a wind tunnel by the following equation:

$$RTI = -t_x u^{\frac{1}{2}} / \ln[1 - (\Delta T_b / \Delta T_g)]$$

where $t_x$ is the actual measured response or actuation time of the sprinkler; u is the gas velocity in the test section with the sprinkler; $\Delta T_b$ is the difference between the actuation temperature of the trigger (determined by a separate heat soak test) and the ambient temperature outside the tunnel (i.e. the initial temperature of the sprinkler); and $\Delta T_b$ is the difference between the gas temperature within the tunnel where the sprinkler is located and the ambient temperature outside the tunnel. The RTI for ESFR sprinkler is determined with air heated to 197 (±2)° C. and passed at a constant velocity of 2.56 (±0.03) m/sec over the sprinkler 10 and trigger 30 inserted into the air stream in the pendent position (see FIG. 1) with a plane through frame arms 50, 52 being perpendicular to the direction of the heated air. The aforesaid FM and UL Standards should be consulted for further information if desired.

When fast response was being investigated in the 1980's, the RTI's so-called standard sprinklers were measured and were found to be more than 100 $m^{1/2}sec^{1/2}$ typically up to nearly 400 $m^{1/2}sec^{1/2}$. RTI's of less than 100 $m^{1/2}sec^{1/2}$ were considered quicker than standard sprinkler responses and referred to as quick response. More recently, quick response has come to denote RTI's of less than 80 $m^{1/2}sec^{1/2}$. Sprinklers incorporating such quick response triggers were referred to as fast response. A class of "special" sprinklers has been recognized having RTI's between 80 and 50 $m^{1/2}sec^{1/2}$. RTI values currently acceptable for ESFR sprinklers are less than 40 $m^{1/2}sec^{1/2}$, more particularly 19 to 36 $m^{1/2}sec^{1/2}$.

The 25 K factor sprinkler 10 will supply 100 gallons per minute at a flow pressure of less than 16 psig while one with a K factor of 26 will supply 100 gallons per minute at just under 15 psi. Applicants believe that 15 psi is the minimum pressure needed to drive drops of the size generated by the sprinkler 10 into the heated plume created by a high challenged fire. The nominal 25 K sprinkler of the present invention therefore is believed to be optimally-sized for its use. However, ESFR sprinklers providing 100 gallon per minute flows at pressures of more than 15 but less than 50 psi can also be commercially valuable. To supply 100 g.p.m. of water at 40 psi requires a K factor of about 16 (15.8). To supply the same amount of water at 30 psig requires a K factor of about 18.5 (18.3) while to supply the same amount of water at 20 psig requires a K factor of about 22.5 (22.4). The reduced diameter portion 14*b* of the internal passageway might have a diameter greater than 0.76 inches to yield a K-factor greater than 16, a diameter of about 0.85 inches to yield a nominal K-factor of about 20, a diameter of about 1.0 inch to yield a K-factor of about 30 and a diameter of about 1.2 inches to yield a K-factor of about 40.

Furthermore, investigations are underway with respect to the suppression of fires even more challenging than those addressed by the original ESFR sprinkler standards. These higher challenges include storage in warehouses piled up to forty feet under forty-five foot ceilings and up to forty-five feet under fifty-foot ceilings. High challenge fires have been successfully suppressed under the forgoing conditions with the aforesaid sprinkler. In particular, the aforesaid sprinkler has successfully suppressed fire in storage piled thirty feet high under thirty-five foot ceilings at 35 psi, in storage piled thirty-five feet high under forty foot ceilings at 40 psi, in storage piled thirty-five feet high under forty-five foot ceilings at 50 psi and in storage piled forty feet high under forty-five foot ceilings also at 50 psi. Applicants believe that water might similarly be supplied in even greater quantities at even lower flow pressures (but still of at least 15 psig to successfully control if not actually suppress such high challenge fires. For example, a flow rate of 120 gallons per minute can be supplied at a pressure of 15 psig (or less) by a K factor of about 31, 140 gallons per minute by a K factor of about 36, and 150 gallons per minute by a K factor of less than 40 (38.7). At pressures of 20 psig, 120 gallons per minute can be supplied by a K-factor of about 27 (26.8), 140 gallons per minute can be supplied by a K-factor of about 31.5 (31.3) and 150 gallons per minute can be supplied by a K-factor of about 33.5.

Figure 10:
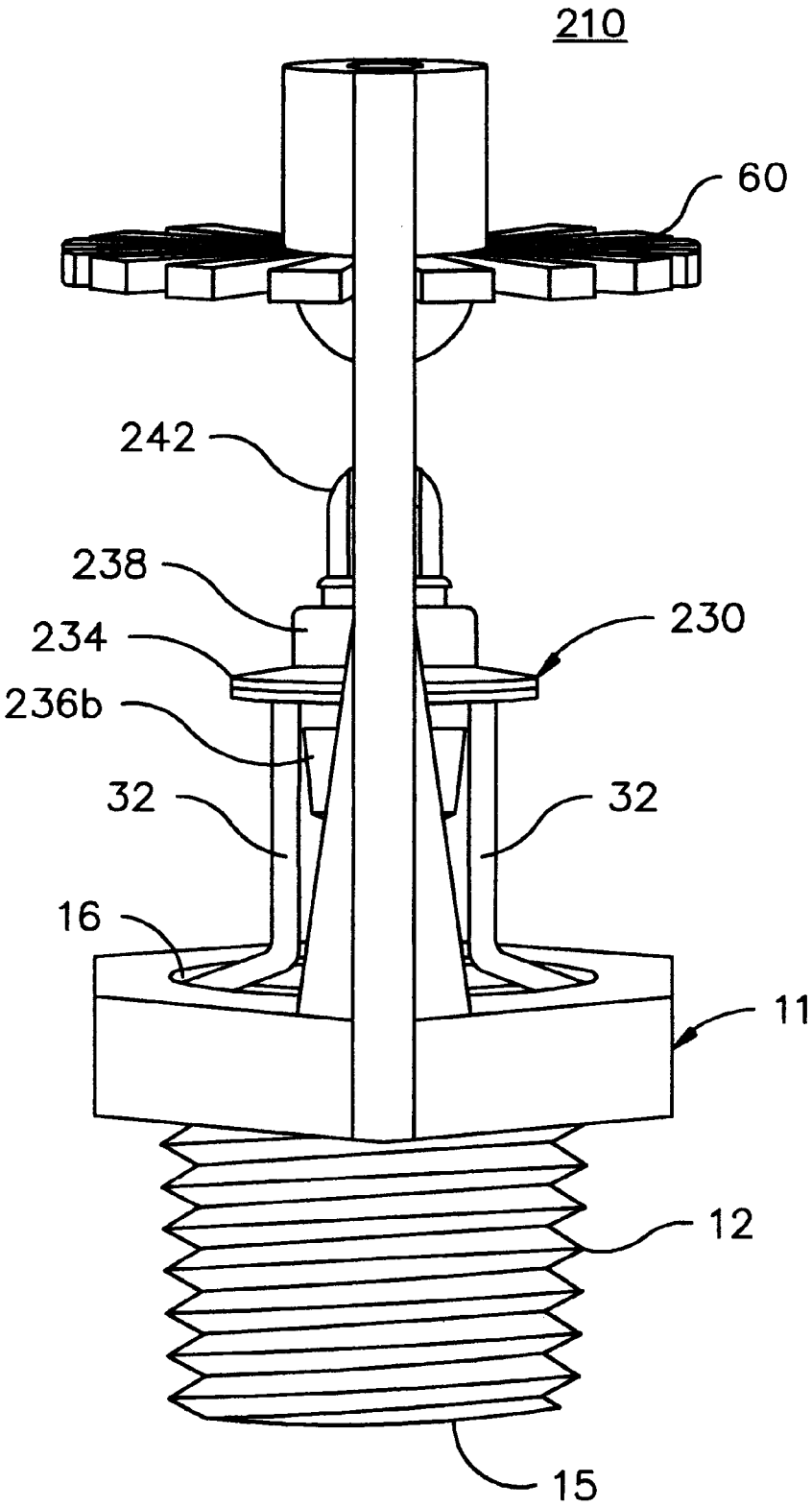
FIGS. 10 and 11 are orthogonal elevation views of a second low pressure, early suppression fast response glass bulb ceiling sprinkler of the present invention.
Figure 11:
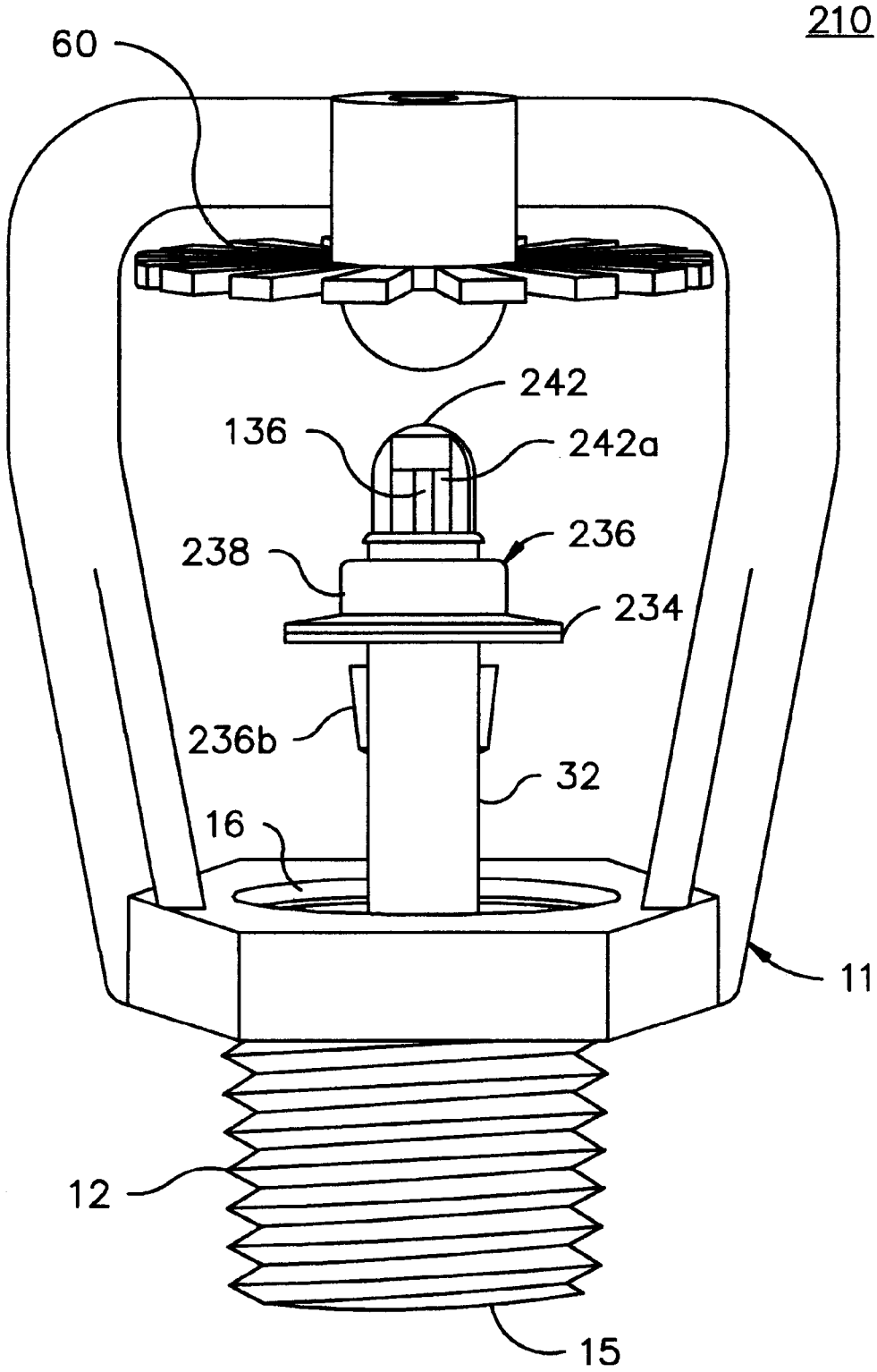
Figure 12:
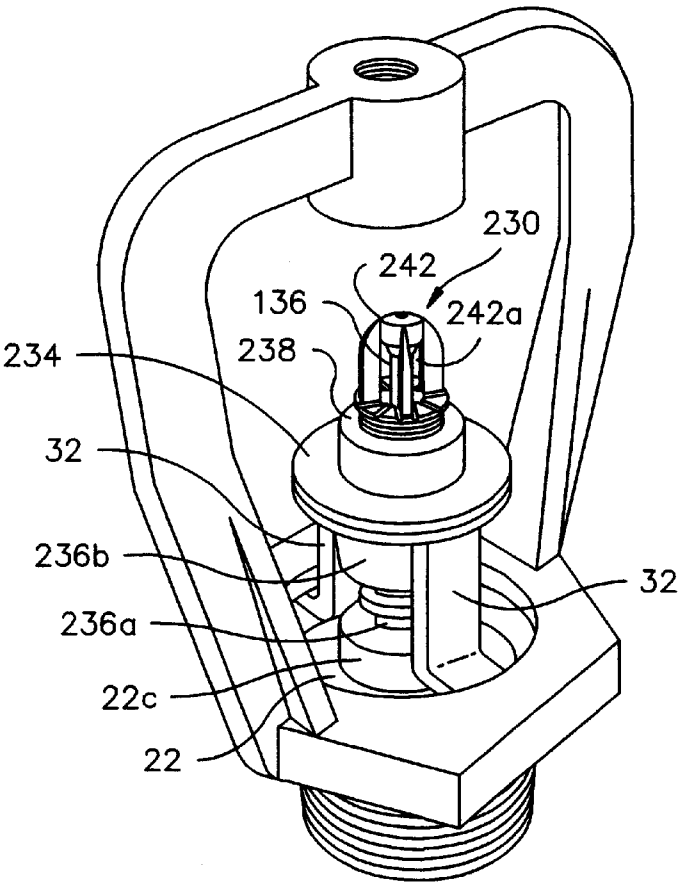
FIG. 12 is a perspective view of the sprinkler of FIGS. 10 and 11 showing details of the mounting supporting the glass bulb and retaining the closure.

FIGS. 6–9 depict in varying views, a first sprinkler indicated generally at 110, which is almost identical to sprinkler 10 of the previous figures but is modified to use a frangible, fluid containing glass bulb as part of the trigger. FIGS. 10–12 depict in varying views, a second sprinkler indicated generally at 210, which is also almost identical to sprinkler 10 of FIGS. 1–5 but modified in a slightly different manner from sprinkler 110 to also use a fluid containing glass bulb as part of the trigger.

Each sprinkler 110 and 210 includes the same one-piece frame 11 as previously described having an at least generally tubular body indicated generally at 12 with a preferably tapered, central, internal passageway 14 extending straight between an inlet end 15 and a discharge end 16 of the tubular body 12 with straight central axis A (see FIGS. 1 and 2). Support arms 50, 52 again extend generally away from opposite sides of the discharge end 16 of the tubular body 12 and meet to form a tubular knuckle 54 located along central axis A which supports deflector 60 positioned juxtaposed to, facing and spaced away from the discharge end 16 of the tubular body 12. Each sprinkler 110 and 210 also includes closure 20, which is releasably positioned at the discharge end 16 of the tubular body 12 so as to close the internal passageway 14.

In sprinkler 110, a heat responsive trigger indicated generally at 130 is provided and includes a frangible, fluid containing glass bulb 136, which is mounted to releasably retain the closure 20 at the discharge end 16 of the tubular body 12 closing the passageway 14 until the trigger 130 is activated. The preferred trigger 130 is an assembly which includes, in addition to bulb 136, a pair of identical, generally L-shaped levers 132 and a yoke 134. Each lever 132 again includes a short arm portion 132*a*, which is again positioned between lip 19 and the downstream end of the closure 20, specifically the saddle 22, releasably retaining the closure 20 in the internal passageway 14 closing the passageway. Long arm portions 132*b* of the levers 132 extend away from discharge end 16 of the tubular body 12 and passageway 14 and are held together by yoke 134. Each long arm portion 132*b* preferably includes a central preferably triangular shaped window 132*c* to provide unobstructed heat flow through the levers 132 to the lateral sides of the bulb 136. The distal end of each long portion 132*b* is also suggestedly curved, generally convexedly toward the bulb 136, to help direct air currents toward the centered bulb 136. Yoke 134 preferably is a one-piece, generally rectangularly-shaped body with a smaller central circular opening 134*a* which is preferably flanked by two, larger circular openings 134*b* (all in phantom). The smaller central opening receives and seats one longitudinal end of bulb 136. The two larger openings permit air to pass through the yoke and circulate over the bulb 136 from below the sprinkler. The yoke 134 also preferably includes a pair of longitudinal tabs 134*c*, which extend through the windows 132*c* of levers 132 and turn away from the closure 20 so as to releasably engage the distal end of each lever 132 to prevent the distal ends from rotating away from each other and the bulb 136, which movement is required to free the levers 132 and release the closure 20. Bulb 136 is held in compression against the yoke 134, holding the yoke in engagement with the levers 132 by a pedestal 38.

Pedestal 138 includes a threaded central shaft 138*a* which is threaded into the central bore of central boss or hub 22*c* and which extends from one side of a bulb holder 138*b*. Holder 138*b* preferably includes a cupped depression 138*c* (FIG. 9) at its distal end, which receives the end of the bulb 136 most proximal to the closure 20. The cupped depression is provided with an axial bore 138*d* which receives a pointed tip of the bulb 136. Preferably a larger bore 138*e* is made transversely into the side of the holder to provide an internal opening in which the pointed tip of the bulb 136 can move without striking a hard surface within the holder which might cause the bulb to break prematurely.

Referring to FIGS. 10–12, trigger 230 of sprinkler 210 is very similar to original trigger 20 and includes the same levers 32. A retainer includes a shaft 236*a* having one end threaded into the closure boss 22*c* and an opposing end threaded into a hollow receiver 236*b*. Receiver 236*b* releasably receives a plunger housing 238 which in turn is mated with a hollow cage 242. One (or more) Belleville washers 234 are trapped between the plunger housing 238 and the receiver 236*b*. The washer 234 is also generally cupped with its concave side facing the closure 22 and receiving the distal ends of the levers 32. The washer 234 replaces yoke 34 to hold the distal ends of the levers 32 together until the sprier 210 is activated. Plunger 238 and cage 242 are joined by adjustable means such as threading to define a hollow chamber which retains a plunger (like plunger 40) and glass bulb 136. The longitudinal end of bulb 136 proximal closure 22 is received in a recess in the head of the plunger. The cage 242 has openings (three) 242*a* at its distal end exposing the distal longitudinal end of the bulb 136 to the surrounding atmosphere. The plunger again supports a plurality of balls, like balls 48, which extend through bores (not depicted) in the side walls of the plunger housing 238 and into an aligned, circumferential recess in the receiver 236*b*, thereby releasably engaging the receiver 236*b* and plunger housing 238. The receiver 236 is held through saddle 22 and the remainder of the trigger 230 is coupled with the saddle 22 through the receiver 236 by means of the balls. The plunger can be forced against the balls by tightening of the cage 242 into the plunger housing 238. When heated sufficiently, the bulb 136 will break, permitting the plunger to move and allow the balls to move into the plunger housing thereby permitting the plunger housing 238 and washer 234 to separate from the receiver 236 and release the levers 32, respectively, thereby releasing closure 20 and permitting water (or other fire fighting fluid) to pass through the sprinkler body 12.

Figure 13:
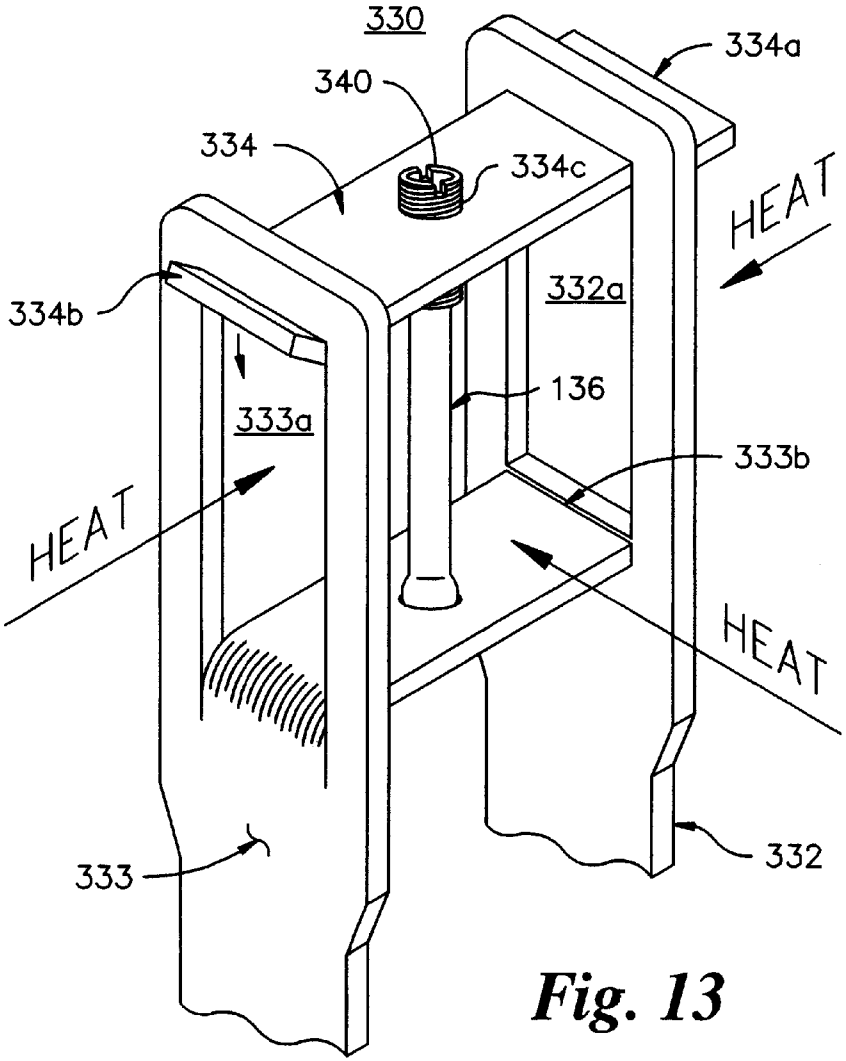
FIG. 13 depicts diagrammatically yet another bulb equipped trigger.

FIG. 13 depicts very diagrammatically, the distinguishing distal end of yet another trigger embodiment indicated generally at 330. The trigger includes asymmetric right and left levers 332 and 333, respectively, an asymmetric yoke 334 and frangible, fluid-filled glass bulb 136. Each lever 332, 333 has a short arm portion (not depicted), bent to fit over a closure 22 and under lip 19 as before. Yoke 336 holds together the distal, longer ends of the levers 332, 333. Each lever includes an opening 332*a*, 333*a*, respectively, and proximal to bulb 136. The portion of original left lever 333 cut to form opening 333*a* is bent generally perpendicularly to the plane of that lever to form a stop 333*b*, which contacts the inner side of right lever 332 and prevents the two levers, 332, 333 from being brought closer together. Stop 332*b* includes a central depression 332*c* with opening, if necessary, to receive and seat the end bulb 136 proximal to the sprinkler closure. The extreme distal end of the levers 332, 333 are held together by means of the yoke 334, which is enlarged at one end 334*a* to form a "TEE" and is bent away from the stop 333*b* at its opposing longitudinal end to form a retaining tab 334*b*. The retaining tab 334*b* is maintained in an engaged position with lever 332 via the bulb 136. Preferably, an adjustment screw 340 is provided in a threaded bore 334*c* in the yoke and has a central bore and a cup depression at the end facing the bulb 136 to receive and seat the bulb. When bulb 136 breaks, the retaining tab 334*b* is free to rotate out of engagement with lever 332. Static pressure on the sprinkler is transmitted through the closure 22 to the levers 332, 333, which will separate and release the closure.

The bulb 136 may be a 2.5 mm, extra fast bulb supplied by Job GmbH of Hamburg, Germany or Norbulb GmbH of Norderfledt, Germany or smaller diameter bulb (e.g., a 2.0 mm bulb supplied by Job).

Sprinkler 110, in particular, offers a simplified construction verses either sprinkler 10 or 210. Moreover, sprinkler 210 with a glass bulb, is less subject to potential failure in the event of corrosive exposure than is sprinkler 10.

The sprinklers 110, 210 incorporate two stages of mechanical advantage for a significant load reduction. A first load reduction of about 4:1 occurs at the junction between the saddle 22 and levers 32 or 132. The second reduction of about 5:1 occurs at the junction between the yoke 134 and bulb holder 138*b* or the Belleville washer 234 and plunger housing-cage 238–242. The discharge end of the central passageway 14 is approximately 0.93 inches in diameter and includes an active seal area of approximately 0.74 $in^2$. This translates to a 74 pounds of load per 100 PSIG of hydrostatic pressure. At 500 PSI, this load equals 370 pounds. (In contrast, a K-14 sprinkler has a seal area that is approximately 0.442 $in^2$, which sees 44.2 pounds of load per 100 PSIG of pressure and about 220 pounds of load at 500 PSIG.)

Testing laboratories heretofore have imposed 500 PSI no leakage requirement and conducted 700 PSI hydrostatic tests on all sprinklers. At this pressure, the load on closure 20 increases to about 520 pounds for the K25 and 310 pounds for the K-14, both of which are considerably above compressive tolerance thresholds of known bulbs fast response bulbs, which are less than 4 mm in nominal diameter. While a linkage mechanism employing a single load reduction stage might be used, dual reduction is preferred because, under the same load conditions (e.g., 520 pounds) a bulb would see approximately 26 pounds of compressive loading, sufficient load reduction to permit the use of 2 mm (or even smaller) bulbs with higher temperature ratings (286° F. or higher) but with essentially the same RTI sensitivity of existing 200° F. 2.5 mm bulbs. The 2 mm bulbs would need to utilize thinner walls and hence be proportionately weaker.

The 4:1 reduction provided by the levers also reduces the frame load. Under 700 PSI hydrostatic load, the deflector/upper frame arms of a single-reduction mechanism would be subject to approximately 520 pounds of load, requiring a robust/stiff/thick component package. With dual reduction, the same components see only approximately about 130 lbs. of load under the 700 PSI hydrostatic test pressure.

It should be appreciated that yoke 134 is shaped with smaller tabs to act as a stop to prevent the bulb from being overcompressed by preventing the distal ends of levers 132 from coming too close to one another.

The undepicted short arm portions of levers 332, 333 are suggestedly bent at an angle of about 105 degrees with respect to the generally parallel, long arm portions of those levers.

Bore 138*e* can be covered by means of a tubular sleeve on receiver 138*b* to prevent possible tampering with the bulb tip in the field. Bore 138*e* is intended to prevent the tip breakage that might occur during original assembly or accidental side loading of the levers during installation. Tip breakage potential increases as the diameter of the bulb decreases. This is due to tip end verses bulb body diameter ratio. In order to assure proper bulb seating and loading, the saddle or holder's vertical bore should reduce proportionally to the bulb's diameter.

U.S. Pat. No. 5,829,532 and Provisional Patent Application No. 60/124,607 filed Mar. 16, 1999 are incorporated by reference herein in its entirety.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A low pressure, early suppression fast response sprinkler comprising:

a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge;

a deflector coupled with the tubular body and spaced from and generally aligned with the discharge end of the internal passageway so as to be impacted by a flow of water issuing from the discharge end of the passageway upon activation of the sprinkler, the deflector being configured and positioned to deflect the flow of water generally radially outwardly all around the sprinkler;

a closure releasably positioned at the discharge end of the tubular body so as to close the internal passageway; and a heat responsive trigger in the form of a fluid containing glass bulb mounted to releasably retain the closure at the discharge end of the tubular body, the glass bulb having a response time index of less than 100 $meter^{1/2}sec^{1/2}$ ($m^{1/2}sec^{1/2}$).

2. The sprinkler of claim 1, wherein the K factor is between 18 and 40.

3. The sprinkler of claim 2, wherein the K factor is greater than 20.

4. The sprinkler of claim 3, wherein the K factor is between 22 and 26.

5. The sprinkler of claim 1, wherein the response time index is less than 80.0 $m^{1/2}sec^{1/2}$.

6. The sprinkler of claim 5, wherein the response time index is less than 40 $m^{1/2}sec^{1/2}$.

7. The sprinkler of claim 2, wherein the response time index is less than 80.0 $m^{1/2}sec^{1/2}$.

8. The sprinkler of claim 7, wherein the response time index is less than 80.0 $m^{1/2}sec^{1/2}$.

9. The sprinkler of claim 3, wherein the response time index is less than 80.0 $m^{1/2}sec^{1/2}$.

10. The sprinkler of claim 9, wherein the response time index is less than 40 $m^{1/2}sec^{1/2}$.

11. The sprinkler of claim 4, wherein the response time index is less than 80.0 $m^{1/2}sec^{1/2}$.

12. The sprinkler of claim 11, wherein the response time index is less than 40 $m^{1/2}sec^{1/2}$.

13. The sprinkler of claim 1, wherein the deflector includes a plate member having a circular outer perimeter with an outer diameter and a plurality of slots extending inwardly from the outer perimeter and axially entirely through the plate member, the slots surrounding a circular slotless central area of the plate member, and the tubular body having a minimum central passageway diameter greater than a maximum diameter of the slotless central area.

14. The sprinkler of claim 1 wherein a ratio of the minimum central passageway diameter to the circular central area diameter is greater than 1.3.

15. The sprinkler of claim 14 wherein a ratio of the minimum central passageway diameter to the circular central area diameter is at least about 1.5.

16. The sprinkler of claim 1, wherein the internal passageway of the tubular body has a minimum orifice diameter greater than 0.75 inches.

17. The sprinkler of claim 1, wherein the internal passageway of the tubular body has a minimum orifice diameter greater than 0.85 inches.

18. The sprinkler of claim 1, wherein the internal passageway of the tubular body has a minimum orifice diameter between 0.75 and 1.2 inches.

19. The sprinkler of claim 1 wherein the heat responsive trigger is an assembly and includes at least a pair of levers maintained in an engagement position with the fluid-containing glass bulb so as to releasably retain the closure at the discharge end of the tubular body closing the internal passageway.

20. The sprinkler of claim 19 wherein the assembly of the heat responsive trigger includes a third member directly engaged with each of the pair of levers and with the glass bulb so as to maintain the pair of levers in the engagement position.

21. The sprinkler of claim 19 wherein the assembly of the heat responsive trigger further includes a plunger, a plurality of balls and a housing, the housing receiving the glass bulb, the plunger and the plurality of balls, the plunger being maintained in an engagement position with the plurality of balls by the glass bulb and the plurality of balls being maintained in an engagement position with the closure by the plunger.

22. The sprinkler of claim 19 wherein the pair of levers provide a first stage of reduction in a compressive load imposed upon the glass bulb by the closure and wherein a remainder of the trigger assembly provides at least a second stage of reduction in the compressive load imposed on the glass bulb by the closure.

23. The sprinkler of claim 22 wherein the first load reduction is at least 4 to 1.

24. The sprinkler of claim 22 wherein the second load reduction is about 5 to 1.

25. The sprinkler of claim 22 wherein the first and second stages provide a reduction of up to about 20 to 1 in the compressive load on the glass bulb from the closure.

26. The sprinkler of claim 1 wherein the trigger is an assembly including a plurality of load-reducing components arranged to couple the glass bulb with the closure and to provide a reduction of at least 4 or more to 1 in a compressive load imposed upon the glass bulb by the closure through the remaining components of the trigger assembly.

27. The sprinkler of claim 26 wherein the plurality of load reducing components of the trigger assembly provide at least two stages of load reduction between the closure and the glass bulb.

28. The sprinkler of claim 26 wherein the plurality of load reducing components of the trigger assembly provide up to about a 20 to 1 reduction in compressive load on the glass bulb from the closure.

29. The sprinkler of claim 1 wherein the glass bulb has nominal diameter less than 4 mm.

30. The sprinkler of claim 1 wherein the bulb has a nominal 2.5 mm diameter.

31. The sprinkler of claim 1 wherein the bulb has a nominal 2 mm diameter.

32. A low pressure, fast response sprinkler comprising:

a generally tubular body having an We t end, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge;

a deflector coupled with the tubular body and spaced from and generally aligned with the discharge end of the internal passageway so as to be impacted by a flow of water issuing from the discharge end of the passageway upon activation of the sprinkler, the deflector being configured and positioned to deflect the flow of water generally radially outwardly all around the sprinkler;

a closure releasably positioned at the discharge end of the tubular body so as to close the internal passageway; and a heat responsive trigger mounted to releasably retain the closure at the discharge end of the tubular body, the trigger having a response time index of less than 100 $meter^{1/2}sec^{1/2}$;

the sprinkler being supplied with water at the inlet end of the tubular body maintained at a pressure of 50 psig or less against the closure.

33. The sprinkler of claim 32 wherein the supplied water is maintained at a pressure of less than 50 psig against the closure.

34. The sprinkler of claim 32 wherein the supplied water is maintained at a pressure of up to about 40 psig against the closure.

35. The sprinkler of claim 32 wherein the supplied water is maintained at a pressure of up to about 35 psig against the closure.

36. The sprinkler of claim 32 wherein the supplied water is maintained at a pressure of up to about 20 psig against the closure.

37. The sprinkler of claim 32 wherein the supplied water is maintained at a pressure of at least about 15 psig against the closure.

38. An installed low pressure, fast response sprinkler comprising:

a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge;

a deflector coupled with the tubular body and spaced from and generally aligned with the discharge end of the internal passageway so as to be impacted by a flow of water issuing from the discharge end of the passageway upon activation of the sprinkler, the deflector being configured and positioned to deflect the flow of water generally radially outwardly all around the sprinkler;

a heat responsive trigger mounted to releasably retain the closure at the discharge end of the tubular body, the trigger having a response time index of less than 100 $meter^{1/2}sec^{1/2}$;

a water supply coupled with the inlet end of the tubular body designed to maintain a water pressure of about 50 psig or less against the closure.

39. The sprinkler of claim 38 wherein the water supply is designed to maintain a water pressure of between 15 and 50 psig against the closure.

40. The sprinkler of claim 38 wherein the water supply is designed to maintain a water pressure of between 15 and about 40 psig against the closure.

41. The sprinkler of claim 38, wherein the water supply is designed to maintain a water pressure of between 15 and about 35 psig against the closure.

42. The sprinkler of claim 38, wherein the water supply is designed to maintain a water pressure of between 15 and about 20 psig against the closure.

43. The sprinkler of claim 38 installed beneath a ceiling having a h eight no more than forty feet.

44. The sprinkler of claim 43 wherein the water supply i s designed to maintain a water pressure of between 15 and 40 psig against the closure.

45. The sprinkler of claim 38 installed beneath a ceiling having a height no more than fifty feet.

46. An installed, low pressure, fast response sprinkler comprising:

a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge;

a deflector coupled with the tubular body and spaced from and generally aligned with the discharge end of the internal passageway so as to be impacted by a flow of water issuing from the discharge end of the passageway upon activation of the sprinkler, the deflector being configured and positioned to deflect the flow of water generally radially outwardly all around the sprinkler;

a heat responsive trigger mounted to releasably retain the closure at the discharge end of the tubular body, the trigger having a response time index of less than 100 $meter^{1/2}sec^{1/2}$;

the sprinkler being installed beneath a ceiling at a height of less than fifty feet.

47. The sprinkler of claim 46 in stalled beneath a ceiling forty-five feet or less in height.

48. The sprinkler of claim 46 installed beneath a ceiling forty feet or less in height.

49. The sprinkler of claim 46 installed beneath a ceiling thirty-five feet or less in height.

50. The sprinkler of claim 46 installed at a height of thirty feet or less.

* * * * *